US009505529B2

(12) United States Patent
Strassburger et al.

(10) Patent No.: US 9,505,529 B2
(45) Date of Patent: Nov. 29, 2016

(54) OVERCAP FOR SUPPORTING AN ELECTRONIC TAG TO A BOTTLE CAP

(71) Applicant: B&G Plastics, Inc., Union, NJ (US)

(72) Inventors: Jake Strassburger, South Plainfield, NJ (US); Daniel V. Cunneen, Waldwick, NJ (US)

(73) Assignee: B&G Plastics, Inc., Union, NJ (US)

( * ) Notice: Subject to any disclaimer, the term of this patent is extended or adjusted under 35 U.S.C. 154(b) by 0 days.

(21) Appl. No.: 14/592,999

(22) Filed: Jan. 9, 2015

(65) Prior Publication Data

US 2015/0302232 A1 Oct. 22, 2015

Related U.S. Application Data

(60) Provisional application No. 61/927,014, filed on Jan. 14, 2014.

(51) Int. Cl.

| | |
|---|---|
| ***H04Q 5/22*** | (2006.01) |
| ***B65D 43/02*** | (2006.01) |
| ***B65D 51/18*** | (2006.01) |

(52) U.S. Cl.

CPC ..... *B65D 43/0235* (2013.01); *B65D 51/18* (2013.01); *B65D 2203/10* (2013.01)

(58) Field of Classification Search

CPC .. B65D 2203/10; B65D 51/18; B65D 55/02; B65D 43/0235

USPC ..... 340/10.1

See application file for complete search history.

(56) References Cited

U.S. PATENT DOCUMENTS

| | | | | |
|---|---|---|---|---|
| 3,685,676 | A | 8/1972 | Gach et al. | |
| 3,756,444 | A | 9/1973 | McIntosh | |
| 3,853,236 | A | 12/1974 | Ostrowsky | |
| 3,915,326 | A | 10/1975 | Hrubesky | |
| 4,405,161 | A | 9/1983 | Young et al. | |
| 4,457,445 | A | 7/1984 | Hanks et al. | |
| 4,471,982 | A | 9/1984 | Nielsen, Jr. | |
| 4,729,487 | A | 3/1988 | Wright | |
| 5,602,530 | A | 2/1997 | Holmgren | |
| 5,667,085 | A | 9/1997 | Ogden et al. | |
| 5,979,326 | A * | 11/1999 | Ohinata | B41J 2/1752 101/494 |
| 6,604,643 | B1 | 8/2003 | Michael et al. | |
| 7,394,383 | B2 | 7/2008 | Hager et al. | |
| 7,804,405 | B2 | 9/2010 | Norman et al. | |
| 7,937,975 | B2 | 5/2011 | Kolton et al. | |
| 8,466,793 | B2 * | 6/2013 | Kolton | G08B 13/2445 340/10.1 |
| 2006/0086808 | A1 * | 4/2006 | Appalucci | B65D 25/205 235/492 |
| 2007/0062903 | A1 * | 3/2007 | Norman | B65D 51/18 215/274 |

* cited by examiner

*Primary Examiner* — Don N Vo

(74) *Attorney, Agent, or Firm* — Hoffman & Baron, LLP

(57) ABSTRACT

An overcap is provided for placement on a cap for a container. The overcap includes a pair of mating components separated by a hinge. Interlocking means is provided for securing the components together about the cap. The interlocking means couples the components for rotation about the cap without causing removable rotation of the cap and preventing non-destructible detachment of the components. The components define a lip for positioning beneath the cap for preventing removal of the overcap therefrom without destructible detachment of the components. The overcap supports an electronic tag therein. The mating components of the overcap include a severable location for removing the overcap from the cap.

10 Claims, 6 Drawing Sheets

OVERCAP FOR SUPPORTING AN ELECTRONIC TAG TO A BOTTLE CAP

CROSS-REFERENCE TO RELATED APPLICATION

This application claims priority to U.S. Provisional Patent Application No. 61/927,014 filed on Jan. 14, 2014, which is incorporated herein by reference.

FIELD OF THE INVENTION

The present invention relates generally to an overcap for supporting an electronic tag. More particularly, the present invention relates to an overcap which may be placed upon a rotatively removable bottle cap.

BACKGROUND OF THE INVENTION

Electronic tags have a wide variety of uses including the tracking of items which contain the tag, inventory control, security and the provision for electronically readable information. These electronic tags take various forms. For example, the tag may include radio frequency identification (RFID) tags, an electronic article surveillance (EAS) tags. Whether for identification, security or other purpose, the tags are typically of one or two types, either dual resonator (DR) tags or radio frequency (RF) tags.

Where product is sold in a container which is closed by a rotatable cap, access to the contents of the container can be achieved by removing the cap prior to purchase and removing all or part of the contents of the container. This would have a tendency to defeat any securing benefits provided by a tag applied to the container. Also, it may be not be readily apparent that the cap has been removed before purchase thereby providing no indication that the container has been tampered with.

Commonly assigned U.S. Pat. No. 7,804,405 discloses an overcap for use with a pharmaceutical container. The overcap may support an electronic tag of the type described herein and is placed on the cap of the container in such a manner that the overcap is rotatable with respect thereto thereby preventing removal of the container cap until the overcap is removed at the time of purchase. While the cap disclosed in the above-referenced patent serves adequately for intended purpose, the two-piece design shown therein is not as cost effective to manufacture and assemble as may be necessary to meet the needs of the consumer market. It is, therefore, desirable to provide a structure which will secure an electronic tag to a container which is easy to manufacture and assemble.

DETAILED DESCRIPTION OF THE PREFERRED EMBODIMENTS

Figure 1:
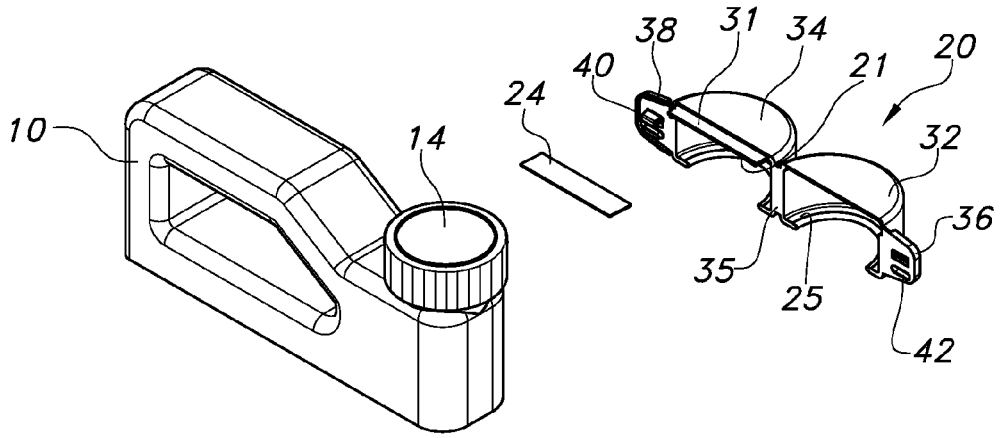
FIGS. 1-3 show one embodiment of the overcap of the present invention for attachment to a cap of a container.

The present invention provides an overcap which may be placed on the rotatable cap of a product container which prevents the unauthorized removal of the container cap without an indication of such removal and also permits the application of an electronic tag to the container.

The first embodiment of the overcap of the present invention is shown in FIGS. 1-7. A container 10 (a portion of which is shown) may be used, for example, to contain a variety of pourable products, such as liquid, powder and the like. The container 10 includes a cap 14 which may be screw threaded to an extending neck of the container to close the container. The present invention provides an overcap 20 for placement over the cap 14 of the container 10. The overcap 20 is an integral one-piece construction and when assembled around the cap 14 (FIG. 3) is generally cylindrical having a flat upper surface 21 and a depending annular skirt 23.

As will be described in further detail hereinbelow, an interior 21 of the outer cap is designed to support an electronic tag 24. The distal end of the skirt 23 includes an inwardly directed lip 25 which will also be described hereinbelow. The overcap 20 is designed to be supported over the container cap 14 and be fixedly rotatable therearound while supporting the electronic tag thereto.

As shown in additional detail in FIGS. 4-7, the overcap 20 is generally of clamshell configuration having two components 32 and 34 separated by a living hinge 35. Each component of 32 and 34 has a generally semi-cylindrical skirt and a pair of extending ears 36 and 38. One of the ears includes projections 40 extending therefrom and the other ear includes apertures 42 which receive the extending projections.

Compartment 34 includes on the underside of the upper surface 21, an extending ledge 31 which accommodates the electronic tag 24 shown in FIG. 1. The electronic tag 24 may be glued or otherwise secured to this ledge in manner well known in the art.

The extending ears 36 and 38 are attached, respectively, to components 32 and 34 by a thinned portion 45. As will be described in further detail hereinbelow, this thin portion allows the overcap to be removed from the cap 14 once the product is purchased.

Figure 2:
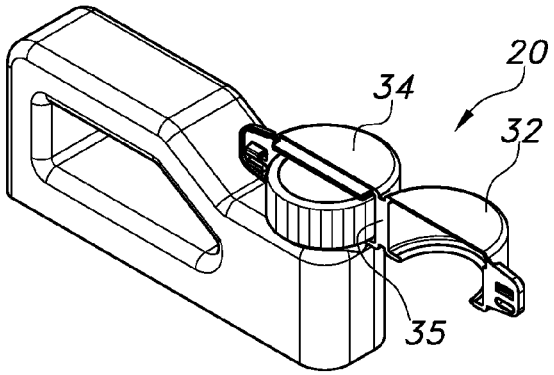
Figure 3:
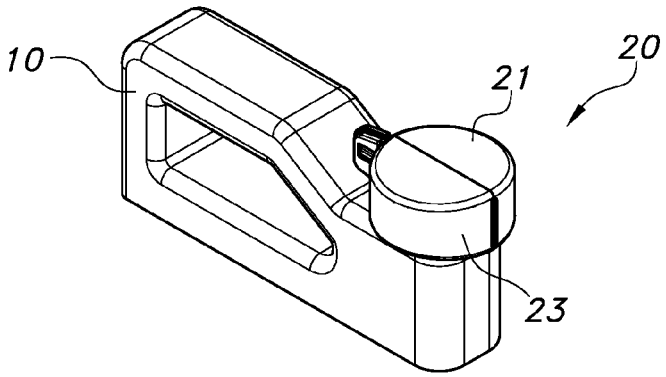
Figure 4:
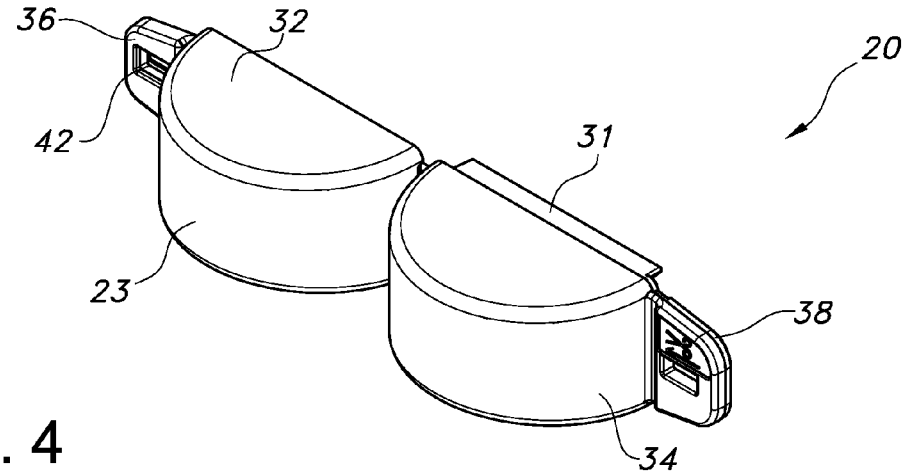
FIGS. 4-7 show, in various depictions, the overcap of FIG. 1 of the present invention.
Figure 5:
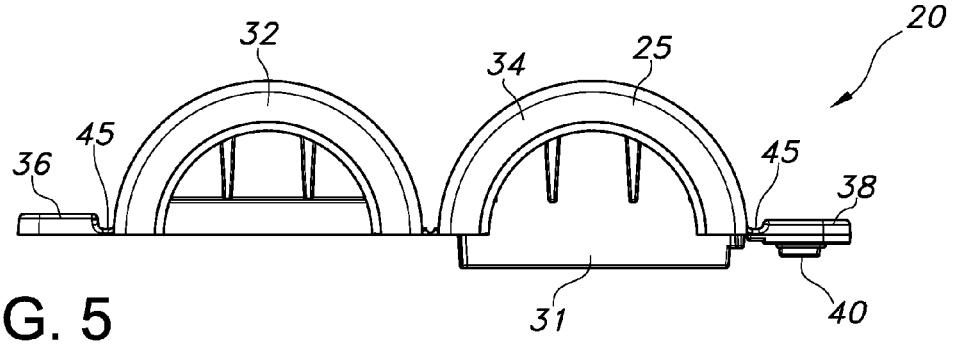
Figure 6:
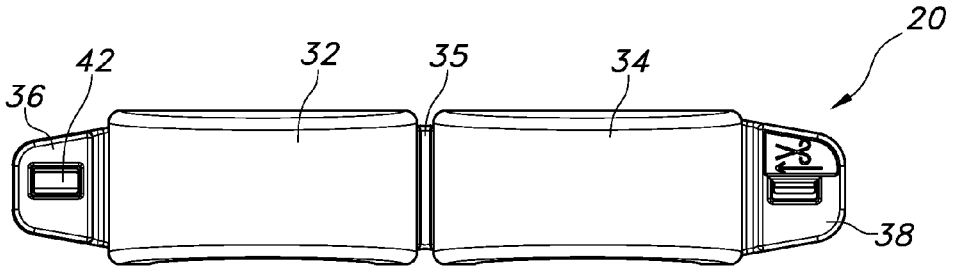
Figure 7:
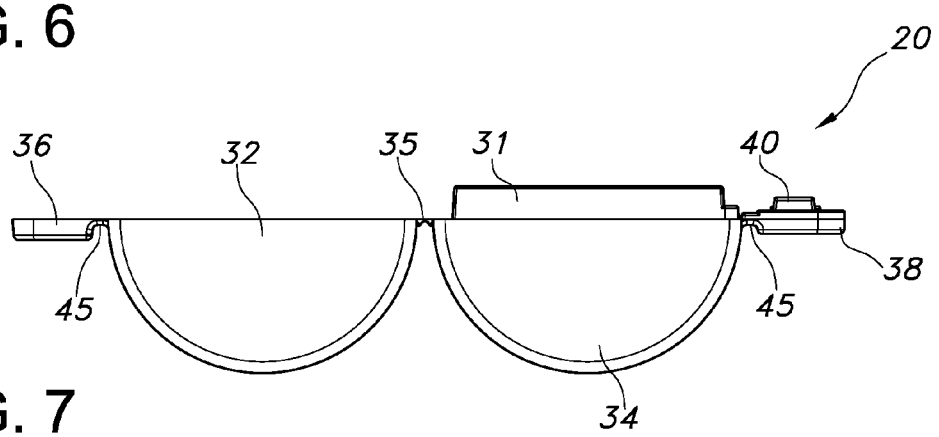

The assembly of overcap 20 to cap 14 of container 10 can now be described with reference to FIGS. 1-3. In its opened condition shown in FIG. 1, the electronic tag 24 is attached to the ledge 31. One of the two components 32 and 34 is placed partially around cap 14 and the other component is closed in a clamshell fashion therearound. The living hinge 35 facilitates such closure. The ears 36 and 38 are placed in juxtaposition such that the projections 40 of ear 38 fit within apertures 42 of ear 36 in a one way snap fit fashion preventing disengagement. The inwardly directed lip 25 is engageable under the cap so as to prevent removal of the overcap 20 from cap 14. In this position, the overcap 20 is fully rotatable about cap 14. With the overcap in place, the overcap cannot be nondestructibly removed from the cap 14. Inasmuch as the overcap is rotatable about cap 14, it also prevents the cap 14 from being removed from the container. Furthermore, as the overcap includes electronic tag 24, it provides the desirable aspects of inventory control and theft prevention.

Once the container is purchased by the consumer, the overcap 20 may be removed by cutting the joined ears 36 and 38 at the thinned area 45 with a suitable tool such as scissors. Once the ears are removed, the clamshell overcap can be opened and removed from the cap 14 and discarded. The container may be used in conventional fashion thereafter.

Figure 8:
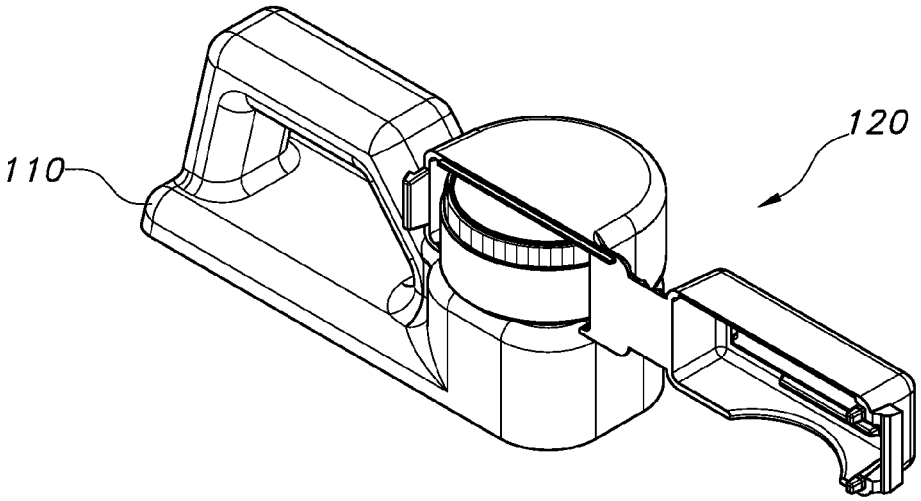
FIGS. 8-10 show a further embodiment of the overcap of the present invention used for attachment to a cap of a container.
Figure 9:
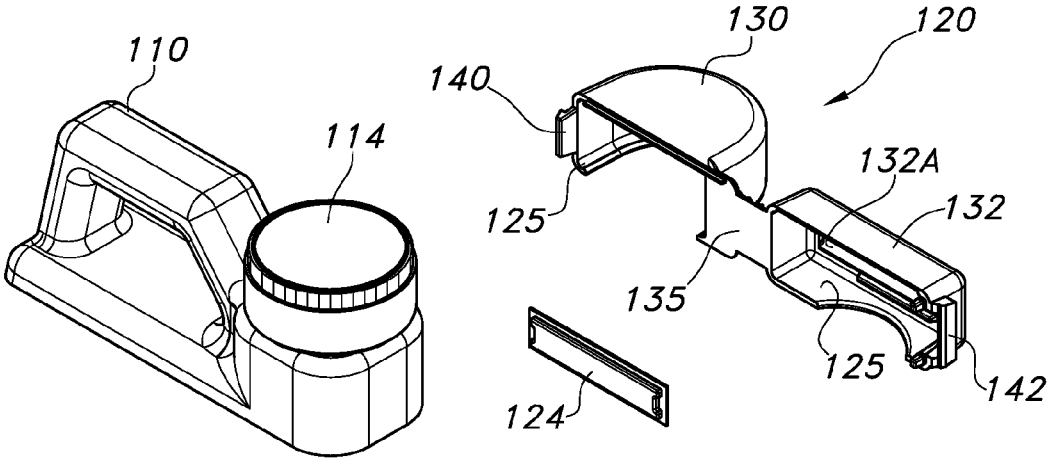
Figure 10:
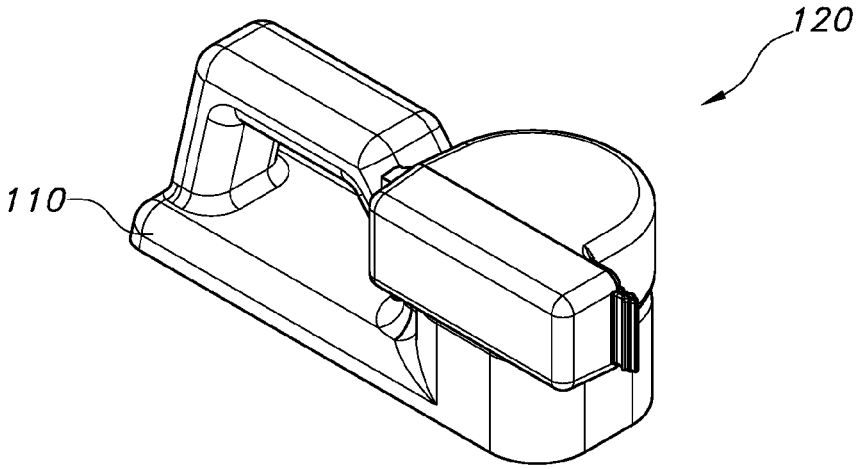
Figure 11:
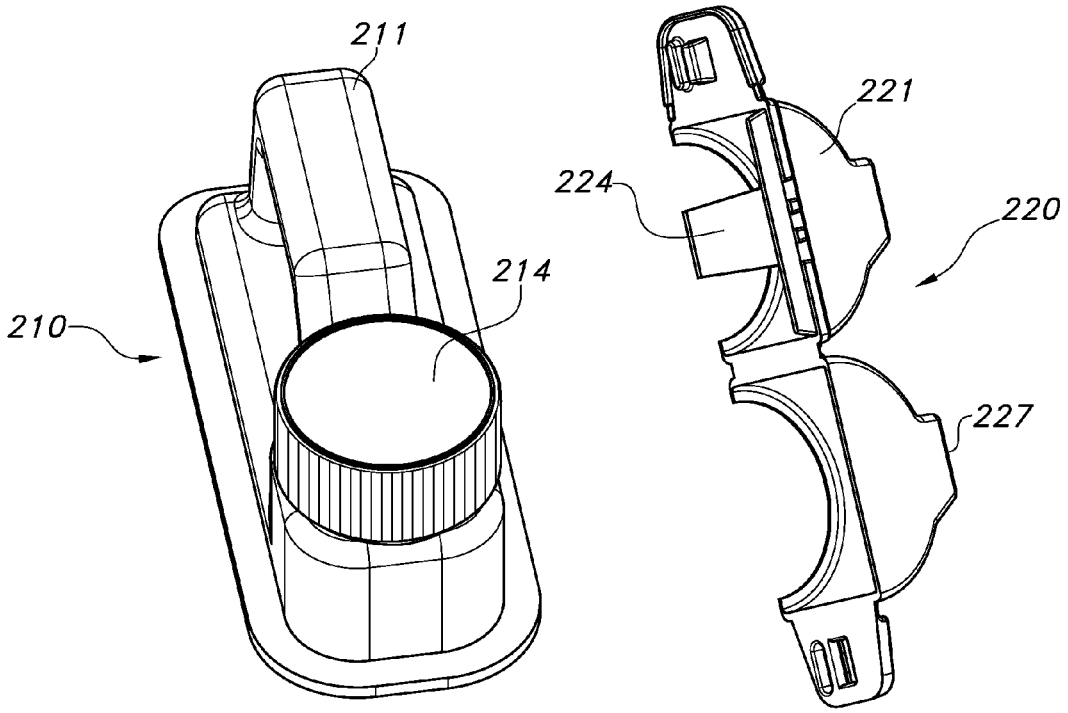
FIGS. 11-15 show and additional embodiment of the overcap of the present invention.
Figure 12:
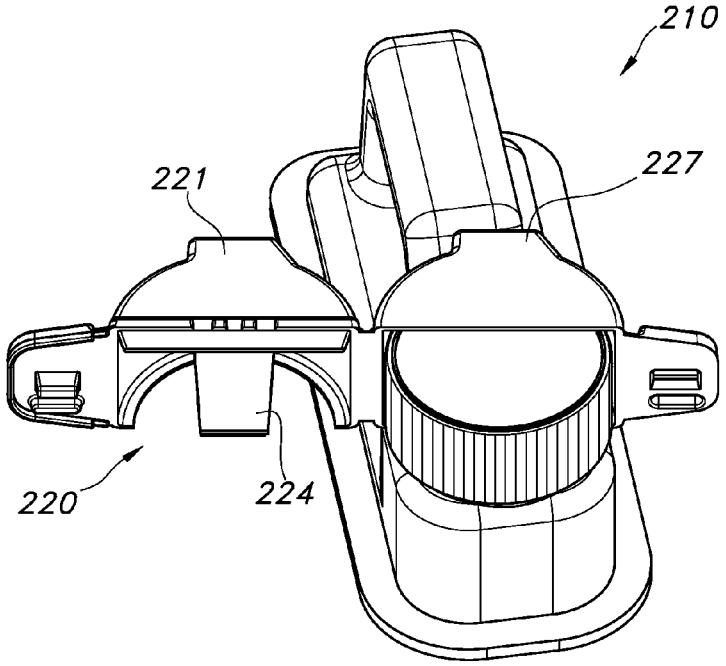
Figure 13:
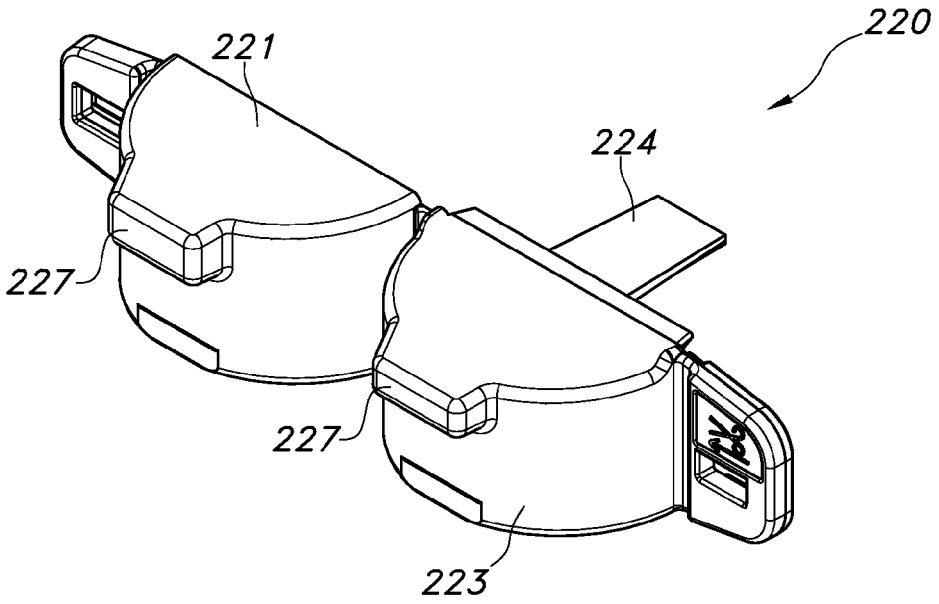
Figure 14:
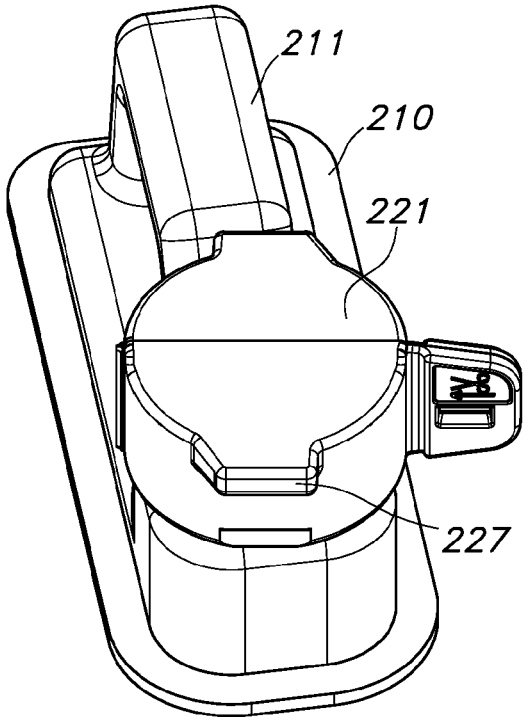

A further embodiment of the present invention is shown with respect to FIGS. 8-10. This embodiment is substantially similar to the embodiment described above and similar reference numerals will be used to describe similar components. In this embodiment, the overcap 120 may be used in combination with a container 110 which includes a cap 114 which may be screw threaded onto an extending neck thereof to close the container. The overcap includes two compartments, a first semi-cylindrical compartment 130 and a second generally rectangular compartment 132 which are interconnected by a living hinge 135. The rectangular compartment 132 is provided in this embodiment inasmuch as the container 110 and cap 114 is smaller than the container and cap shown in the embodiment described above. This necessitates the overcap 120 to be of smaller construction. Since the overcap is of smaller construction, it is difficult to provide sufficient dimension on the underside of upper surface 132 to accommodate the electronic tag 124. Thus, the rectangular compartment 132 is provided to assure that surface 132 is of sufficient dimension to accommodate the electronic tag thereagainst.

Component 130 has a projecting latch 140 which is lockingly insertable into a projecting recess 142 on component 132 to lock the overcap in closed condition around cap 114. When closed about the cap 114, both components 130 and 132 of overcap 120 provide a inwardly directed lip 125 which supports the overcap 120 over the cap 114 as shown in FIGS. 8-10.

The embodiment shown herein functions substantially similar to the embodiment shown above where the compartment 132 is folded about living hinge 135 to close with compartment 130 around cap 114. Once folded, as shown in FIG. 10, the living hinge extends from one side of the overcap. The projecting latch 140 lockingly engages the projecting recess 142 to provide a one way snap fit engagement thereby preventing the overcap 120 from being non-destructively removed from the cap 114. In this position, the overcap 120 is fully rotatble about cap 114 and also prevents the contents of the container from being accessed without removal of the overcap. Once the container is purchased by the consumer the overcap may be removed by cutting the hinge 135. Once the hinge is cut, the overcap 120 can be opened about the cap 114 and be removed. The container can be then used in conventional fashion.

A still further embodiment of the present invention is shown with respect to FIGS. 11-14. This embodiment is substantially similar to the embodiment described hereinabove and similar reference numerals will be used to describe similar components.

In the present embodiment, the overcap 220 may be used in combination with a container 210 which includes a cap 214 which may be screwed threaded onto the extending neck thereof to close the container 210. The overcap 220 is an integral one-piece member, which when assembled around the cap 214, is generally cylindrical having a flat upper surface 221 and a depending annular skirt 223. The overcap 220 of the present embodiment is designed for use on smaller containers where space between the handle 211 of the container and the cap 214 is minimal. Thus, as with the embodiment immediately described above, the overcap 220 is of smaller construction.

Since it is of smaller construction, it is also difficult to provide sufficient dimension on the circular upper surface 221 to accommodate the electronic tag 224. Thus, in the present embodiment, the upper surface of cap 214 includes diametrically opposed extending fingers 227 which extends the diameter of the cylindrical overcap 220. This provides an elongate surface for accommodating the elongate rectangular tag 224.

Figure 15:
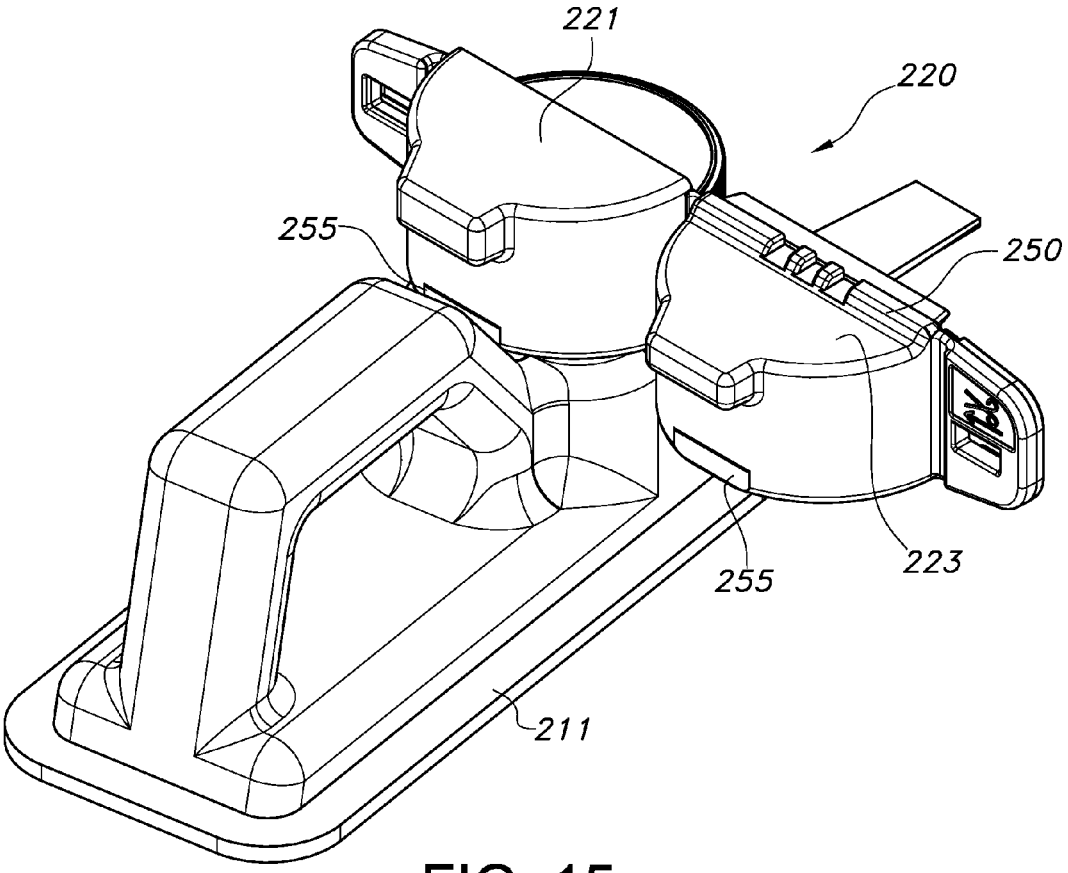

Also, as shown in FIG. 15, the upper surface 221 of the overcap 220 may include strengthening ribs 250 to prevent deformation of the overcap.

Still further as shown in FIG. 15, in order to accommodate the overcap 220 between the cap 214 and handle 211 of the container 210, flat areas 255 may be provided on diametrically opposed sides of the overcap 220 so that the overcap may fit between the cap 214 and the container handle 211.

Various changes to the foregoing described and shown structures would now be evident to those skilled in the art. Accordingly, the particularly disclosed scope of the invention is set forth in the following claims.

What is claimed is:

1. An overcap for placement on a cap rotatably positioned on a container comprising:

a pair of integrally formed mating components separated by a hinge;

said pair of components including cooperative one-way interlocking structure for securing said components together about said cap for rotation about said cap without causing removable rotation of said cap and preventing non-destructible detachment of said components;

said components defining a lip for positioning beneath said cap for preventing removal of said overcap therefrom without detachment of said components; and an electronic tag supported within said overcap;

said mating components including mutually engaged portions defining a thinned portion through both mating components and wherein said thinned portion through both mating components defines a severable location for removing said overcap from said cap.

2. An overcap of claim 1 wherein said tag is selected from the group consisting of an EAS tag and a RFD tag.

3. An overcap of claim 1 wherein said severable location includes said hinge.

4. An overcap of claim 1 wherein said severable location includes said interlocking structure.

5. An overcap of claim 1 wherein said overcap is generally cylindrical having a flat upper surface and a depending annular skirt.

6. An overcap of claim 5 wherein said flat upper surface includes diametrically extending fingers for accommodating said electronic tag.

7. An overcap of claim 5 wherein said depending annular skirt included flat surfaces.

8. An overcap of claim 1 wherein said mating component includes a first semi-cylindrical component and a second rectangular component.

9. An overcap of claim 8 wherein said rectangular component accommodates said electronic tag.

10. An overcap of claim 1 wherein said mating components each include an extending ear and wherein said extending ears include said interlocking structure, said severable location including said ears.

* * * * *